US008944670B2

(12) United States Patent
Kim

(10) Patent No.: US 8,944,670 B2
(45) Date of Patent: Feb. 3, 2015

(54) BASE FOR LED LAMP, BASE SET FOR LED LAMP, SOCKET SET FOR LED LAMP, AND LAMP ASSEMBLY USING THE SAME

(75) Inventor: Ha chul Kim, Seoul (KR)

(73) Assignee: Lumirich Co., Ltd., Incheon (KR)

( * ) Notice: Subject to any disclaimer, the term of this patent is extended or adjusted under 35 U.S.C. 154(b) by 437 days.

(21) Appl. No.: 13/291,247

(22) Filed: Nov. 8, 2011

(65) Prior Publication Data

US 2012/0113631 A1 May 10, 2012

(30) Foreign Application Priority Data

Nov. 8, 2010 (KR) ..... 20-2010-0011467 U

(51) Int. Cl.

| | |
|---|---|
| ***F21V 25/04*** | (2006.01) |
| ***F21V 23/04*** | (2006.01) |
| ***H01R 33/955*** | (2006.01) |
| ***F21K 99/00*** | (2010.01) |

(52) U.S. Cl.

CPC ..... *F21V 25/04* (2013.01); *H01R 33/955* (2013.01); *F21K 9/175* (2013.01)

USPC ..... 362/659; 362/217.17; 362/221; 362/394; 439/242

(58) Field of Classification Search

CPC ..... F21Y 2101/02; F21Y 2103/003; F21Y 2103/00; F21Y 2111/001; H01L 2924/00014; F21K 9/00; F21K 9/17; F21V 19/0005; F21V 19/001; F21V 19/0075; F21V 9/175; F21V 25/04

USPC ..... 362/659, 217.01–217.17; 439/236, 242

See application file for complete search history.

(56) References Cited

U.S. PATENT DOCUMENTS

| | | | | |
|---|---|---|---|---|
| 7,053,557 | B2 * | 5/2006 | Cross et al. | 315/74 |
| 7,946,729 | B2 * | 5/2011 | Ivey et al. | 362/254 |
| 8,147,091 | B2 * | 4/2012 | Hsia et al. | 362/221 |
| 8,459,829 | B2 * | 6/2013 | Cao et al. | 362/217.14 |
| 8,531,109 | B2 * | 9/2013 | Visser et al. | 315/88 |
| 2010/0046222 | A1 * | 2/2010 | Yang | 362/249.02 |

FOREIGN PATENT DOCUMENTS

| | | |
|---|---|---|
| JP | 2001-52504 | 2/2001 |
| JP | 2004-303614 | 10/2004 |
| JP | 2007-305584 | 11/2007 |
| JP | 2009-43447 | 2/2009 |
| JP | 3155960 | 11/2009 |
| JP | 2010-40502 | 2/2010 |
| JP | 2010-102440 | 5/2010 |
| JP | 3160410 | 6/2010 |
| JP | 2010-153345 | 7/2010 |
| JP | 2010-157453 | 7/2010 |
| JP | 2010-192224 | 9/2010 |

* cited by examiner

*Primary Examiner* — Alan Cariaso
(74) *Attorney, Agent, or Firm* — Rabin & Berdo, P.C.

(57) ABSTRACT

The base for a light emitting diode lamp according to an embodiment of the present invention includes: a cap which covers an end of a tube of the light emitting diode lamp; and two pins which are extended respectively from the cap toward the outside of an end of the tube. One of the two pins is nonconductive and the other one of the two pins is conductive.

10 Claims, 3 Drawing Sheets

BASE FOR LED LAMP, BASE SET FOR LED LAMP, SOCKET SET FOR LED LAMP, AND LAMP ASSEMBLY USING THE SAME

CROSS-REFERENCE TO RELATED APPLICATION

This application claims priority to and the benefit of Korean Utility Model Application No. 20-2010-0011467 filed in the Korean Intellectual Property Office on Nov. 8, 2010, the entire contents of which are incorporated herein by reference.

FIELD OF THE INVENTION

The present invention relates to a base set for light emitting diode (LED) lamp, a socket set for LED lamp, and lamp assembly using the same.

BACKGROUND ART

Generally, a fluorescent lamp is illuminated by being applied with an alternating current of about 100 to 1,500V. On the other hand, a tubular light emitting diode (LED) lamp is developed to substitute the conventional fluorescent lamp, and an alternating current is input to a switching mode power supply (SMPS) to be converted to a direct current, and then the converted direct current is applied to the tubular LED, and thereby the light emitting diode emits light using the direct current.

As such, since the LED is a semiconductor using a direct current, and life span of the LED may be decreased or malfunction may occur when an alternating current which is generally applied to a fluorescent lamp is applied thereto.

For example, if a base which is similar to a base of a fluorescent lamp is used to the LED lamp, a general user may confuse the LED lamp with the fluorescent lamp and thus connects the LED lamp to a socket for a fluorescent lamp, and this may cause problems. In order to solve this problem, a method of forming a base for the LED lamp to be differentiable from a conventional base of a fluorescent lamp has been introduced.

In addition, although a shape of the base for the LED lamp is configured to be different from the base of the fluorescent lamp, if the base has a shape and structure which can be connected to the socket of the fluorescent lamp, an alternating current may be applied to the LED, and this may cause the similar problem.

Technical Problem

The present invention has been made in an effort to provide a base set for a lighting emitting diode lamp, a socket set for a light emitting diode lamp, and a lamp assembly using the same in which an alternating current is not applied to a light emitting diode, if it is not provided with a wiring with a switching mode power supply (SMPS) supplying a direct current only user for a light emitting diode, when a user connects a light emitting diode lamp to a conventional lamp assembly of a fluorescent lamp by mistake.

In addition, the present invention has been made in an effort to provide a base set for a lighting emitting diode lamp, a socket set for a light emitting diode lamp, and a lamp assembly using the same which can substantially reduce time and cost for replacing a conventional fluorescent lamp with a light emitting diode lamp.

Technical Solution

An exemplary base for a light emitting diode lamp according to an embodiment of the present invention includes: a cap which covers an end of a tube of the light emitting diode lamp; and two pins which are extended respectively from the cap toward the outside of an end of the tube. One of the two pins is nonconductive and the other one of the two pins is conductive.

The two pins may be connected to a socket for a light emitting diode, and the socket comprises two pin holes into which the two pins are connected.

The socket for the light emitting diode may be a socket for a fluorescent lamp.

The socket may be connected to a switching mode power supply (SMPS), which converts a supplied alternating current to a direct current and applies the converted direct current, so that the light emitting diode lamp can be driven by being supplied with the converted direct current to the other conductive one of the two pins.

A base set for a light emitting diode lamp according to an embodiment of the present invention includes: a first base for a light emitting diode having a first cap which covers one end of a tube of the light emitting diode and two first pins which are extended respectively from the first cap toward the outside of the one end of the tube; and a second base for a light emitting diode having a second cap which covers the other end of the tube of the light emitting diode and two second pins which are extended respectively from the second cap toward the outside of the other end of the tube. One or two of the two first pins and the two second pins is nonconductive and the other thereof are conductive.

The two first pins and the two second pins may be respectively connected to a first socket for a light emitting diode lamp and a second socket for a light emitting diode lamp, and first socket and the second socket respectively may include two first pin holes and two second pin holes into which the two first pins and the two second pins are respectively connected.

The first socket and the second socket may be respectively a socket for a fluorescent lamp.

The first socket and the second socket may be respectively connected to a switching mode power supply (SMPS), which converts a supplied alternating current to a direct current and applies the converted direct current, so that the light emitting diode lamp can be driven by being supplied with the converted direct current to the other conductive pins.

A socket set for a light emitting diode lamp according to an embodiment of the present invention includes: a switching mode power supply (SMPS) which converts a supplied alternating current to a direct current and applies the converted direct current to a base set for a light emitting diode lamp including a first base for a light emitting diode having a first cap which covers one end of a tube of the light emitting diode and two first pins which are extended respectively from the first cap toward the outside of the one end of the tube, and a second base for a light emitting diode having a second cap which covers the other end of the tube of the light emitting diode and two second pins which are extended respectively from the second cap toward the outside of the other end of the tube, one or two of the two first pins and the two second pins being nonconductive and the other thereof being conductive; a first socket for a light emitting diode lamp including two first pin holes into which the two first pins are connected; and a second socket for a light emitting diode lamp including two second pin holes into which the two second pins are connected. The SMPS is connected to the first socket and the second socket so that the light emitting diode lamp can be driven by being supplied with the converted direct current to the other conductive pins.

The first socket and the second socket may be respectively a socket for a fluorescent lamp.

A lamp assembly according to an embodiment of the present invention includes: a cover frame an inside of which is opened in a downward direction and an upper surface of which is connected to a ceiling; a socket set for a light emitting diode lamp being connected to the cover frame; and a light emitting diode including a base set for a light emitting diode lamp, the base set being connected to the socket set. The socket set includes: a switching mode power supply (SMPS) which converts a supplied alternating current to a direct current and applies the converted direct current to the base set; a first socket for a light emitting diode lamp including two first pin holes into which the two first pins are connected; and a second socket for a light emitting diode lamp including two second pin holes into which the two second pins are connected. The SMPS is connected to the first socket and the second socket so that the light emitting diode lamp can be driven by being supplied with the converted direct current to the other conductive pins. The base set includes: a first base for a light emitting diode having a first cap which covers one end of a tube of the light emitting diode and two first pins which are extended respectively from the first cap toward the outside of the one end of the tube; and a second base for a light emitting diode having a second cap which covers the other end of the tube of the light emitting diode and two second pins which are extended respectively from the second cap toward the outside of the other end of the tube. One or two of the two first pins and the two second pins is nonconductive and the other thereof are conductive.

The two first pins and the two second pins may be respectively connected to the first socket and the second socket, and the first socket and the second socket respectively may include two first pin holes and two second pin holes into which the two first pins and the two second pins are respectively connected.

The first socket and the second socket may be respectively a socket for a fluorescent lamp.

The first socket and the second socket may be respectively connected to the SMPS.

Advantages Effects

According to a present invention, since one or two of four pins provided to both ends of the base is nonconductive and the other are conductive, an alternating current is not applied to a light emitting diode, if it is not provided with a wiring with a switching mode power supply (SMPS) supplying a direct current only user for a light emitting diode, when a user connects a light emitting diode lamp to a conventional lamp assembly of a fluorescent lamp by mistake, so problems such as decrease of life span, malfunction, fire risk which may be caused by applying of unsuitable current to the LED lamp can be prevented.

In addition, since a conventional socket of a fluorescent lamp can be directly used as a socket for a light emitting diode lamp, time and cost for replacing a conventional fluorescent lamp with a light emitting diode lamp can be substantially reduced.

BRIEF DESCRIPTIONS OF DRAWINGS

DETAILED DESCRIPTION OF THE EMBODIMENTS

Embodiments of the present invention will be explained in detail with reference to the accompanied drawings.

Figure 1:
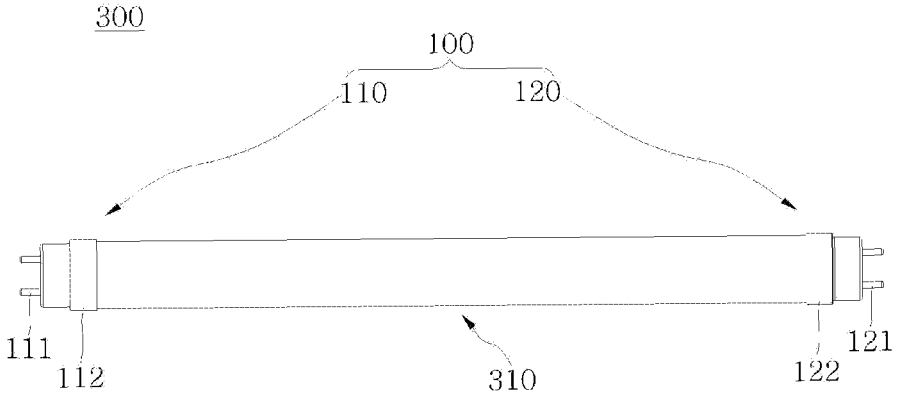
FIG. 1 is a drawing showing a light emitting diode lamp provided with a base set for an LED lamp according to an embodiment of the present invention.
Figure 2A:
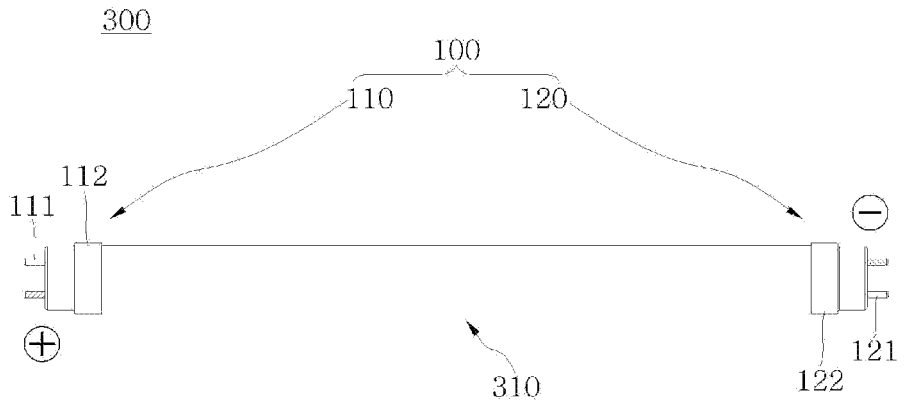
FIG. 2A, FIG. 2B and FIG. 2C are drawings showing an LED lamp for explaining operation method of a base for LED lamp according to an embodiment of the present invention.
Figure 2B:
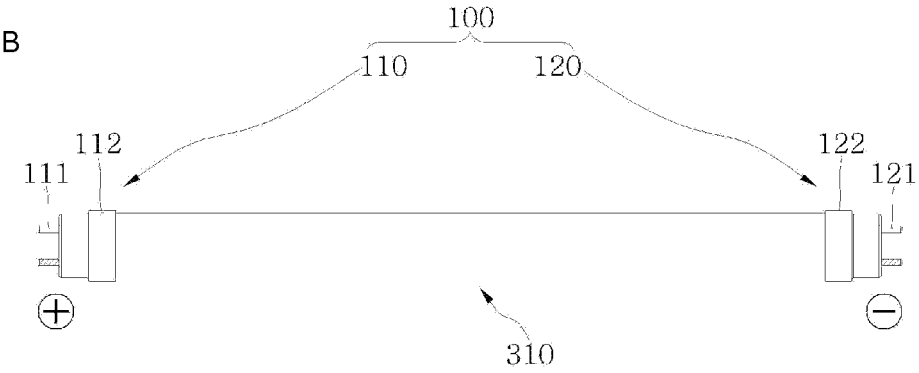
Figure 2C:
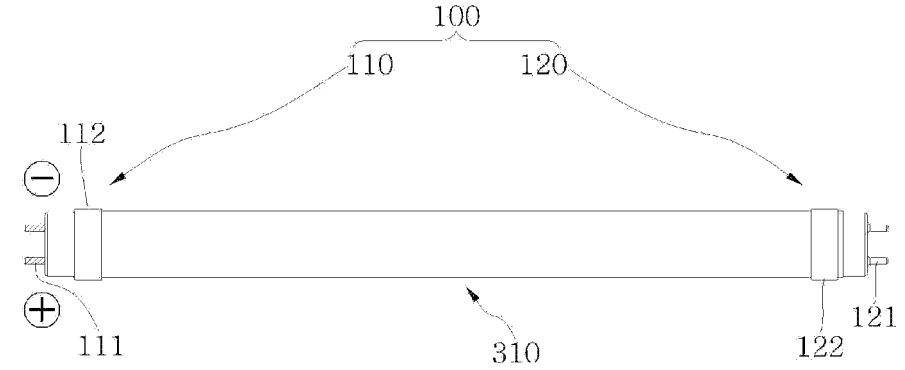
Figure 3:
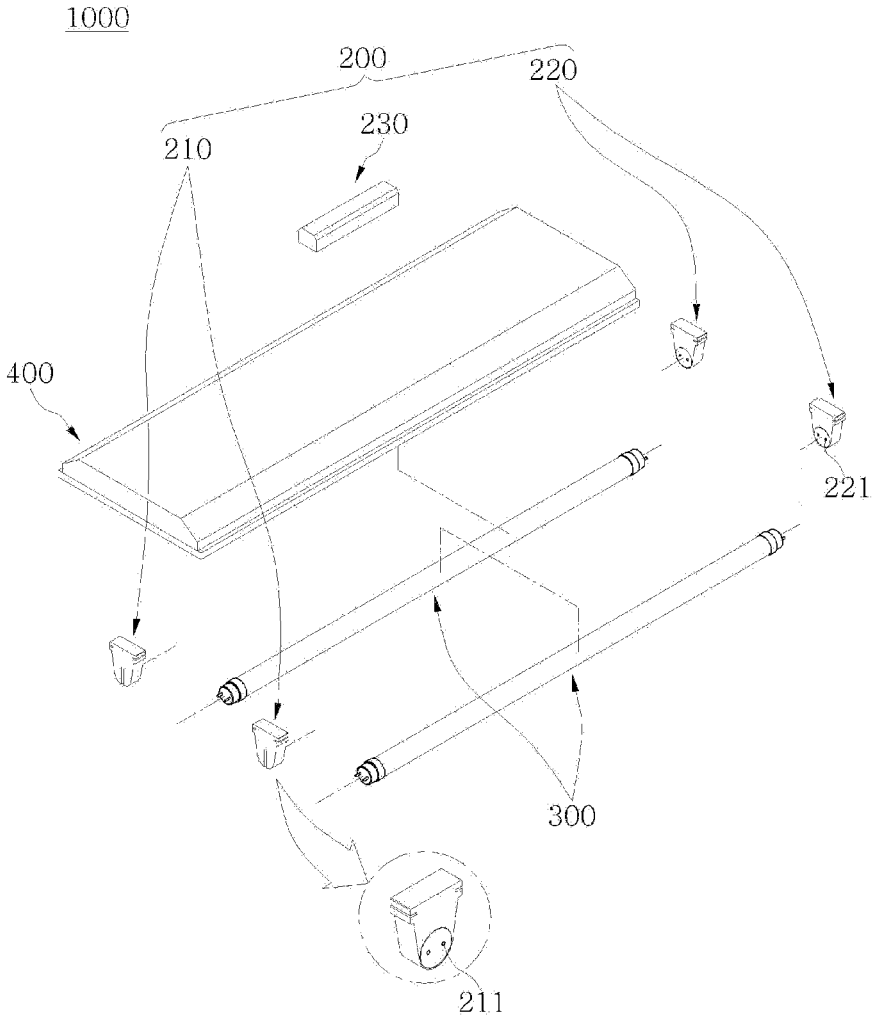
FIG. 3 is a schematic exploded perspective view of a lamp according to an embodiment of the present invention.

Referring to FIG. 1 to FIG. 3, a base set 100 for LED lamp according to an embodiment of the present will be explained. Since the base set 100 is coupled to a socket set 200 for LED lamp according to an embodiment of the present invention and may be a part of a lamp assembly 1000 according to an embodiment of the present invention, parts of the socket set 200 and the lamp 1000 may be mentioned together with the explanation of the base set 100.

Referring to FIG. 1 to FIG. 2C, the base set 100 may include a first base 110 for an LED lamp and a second base 120 for an LED lamp. In order to explanation the features of the present invention, the first base 110 and the second base 120 are explained.

First, as shown in FIG. 1, the first base 110 includes a first cap 112 which covers an end of a tube 310 of a light emitting diode (LED) lamp 300, and two first pins 111 which are extended respectively from the first cap 112 toward the outside of an end of the tube 310.

Next, as shown in FIG. 1, the second base 120 includes a second cap 122 which covers the other end of the tube 310 of the LED lamp 300, and two second pins 121 which are extended respectively from the second cap 122 toward the outside of the other end of the tube 310.

Here, referring to FIG. 2A to FIG. 2C, one or two of the four pins 111 and 121, i.e., the two first pins 111 of the first base 110 and the two second pins 121 of the second base 120, is electrically nonconductive and the other are electrically conductive.

As an example, in embodiments shown in FIG. 2A and FIG. 2B, one of the two first pins 111 and one of the two second pins 121 are nonconductive, and the other two are conductive. However, in FIG. 2A, the nonconductive one of the two first pins 111 and the nonconductive one of the two second pins 121 are arranged to be crossed with each other, and in FIG. 2B, the nonconductive one of the two first pins 111 and the nonconductive one of the two second pins 121 are arranged at the same side. In addition, in an embodiment shown in FIG. 2C, both of the two second pins 121 are nonconductive, and both of the two first pins 111 are conductive.

The nonconductive pin may be realized by various methods such as a method of forming one or two of the nonconductive pin among the four pins 111 and 121 using nonconductive material, a method of covering one or two of the nonconductive pin among the four pins 111 and 121 with nonconductive material, or the like.

As such, the structure one or two of the four pins 111 and 121 is nonconductive and the others are conductive is one of features of the present invention, and the reason will be explained.

In case LED lamp is connected to a conventional socket for a fluorescent lamp, there may be a possibility of occurrence of malfunction which may be harmful to a user. Since a light emitting diode (LED) is a semiconductor using a direct current, the span of life of LED may be decreased or abnormal operation of LED may occur in case that an alternating current which is applied to a conventional fluorescent lamp is applied to the LED lamp.

The conventional fluorescent lamp is configured to cause light emission on an electrode therein using an alternating current of about 100 to 1,500V output from a ballast stabilizer. At this time, bases on both sides of the fluorescent lamp are respectively provided with two pins, and light emission of the electrode (i.e., lighting of the fluorescent lamp) is possible only when an alternating current are applied to all of the four pins on both sides.

Based on the idea that the lighting of the fluorescent lamp is possible when electric power are applied to all of the four pins, by making one or two of the four pins 111 and 121 nonconductive and making the other conductive, although a user connects LED lamp to a socket for the conventional fluorescent lamp which is provided with a ballast stabilizer of the conventional fluorescent lamp by mistake, the base set 100 for LED lamp does not operate at all except the case of being provided with a circuit using a switching mode power supply (SMPS) 230 for the LED lamp 300 using a direct current. In addition, according to this, phenomenon that load caused by applying of unsuitable current to the LED lamp 300 and a ballast stabilizer for the conventional fluorescent lamp occurs may be prevented.

According to this idea, if only one of the four pins 111 and 121 is nonconductive, electric current is not applied so that it is safe even when it is connected to a conventional socket of a fluorescent lamp. That is, in view of nonconductive pin, it is sufficient that only one of the nonconductive pin is provided with for the safety. However, in view of conductive pin, it is sufficient that only two conductive pins are provided with for applying of a direct current as shown in FIG. 2A to FIG. 2C. Accordingly, these requirements are satisfied that the number of the four pins 111 and 121 is one or more, and the number of the conductive pin is two.

Accordingly, although the number of the nonconductive pin is not limited to two, embodiments of the present invention will be explained with reference to the case that the nonconductive pins are two and the conductive pins are also two (referring to FIG. 2A to FIG. 2C).

In case that two of the four pins 111 and 121 are nonconductive and the other two thereof are conductive, the base set 100 of the LED lamp is configured such that two pins 111 or 121 which are disposed on one side among the first base 110 and the second base 120 which are provided on both sides of the tube 310 of the LED lamp 300 or respective one of the respective two pins 111 and 121 of the first base 110 and the second base 120 are formed with nonconductive material, and thereby electricity is applied thereto only when a suitable alternating current for driving the LED lamp 300 is applied.

In other words, since the conductive pin and the nonconductive pin are separately formed in the base set 100, even when an alternating current for the fluorescent lamp is applied to the LED lamp 300 through the four pins 111 and 121 in a state that the SMPS 230 for the LED lamp is not properly connected to the sockets 210 and 220 for the LED lamp, the alternating current is not applied to the LED lamp 300, and thereby the safer LED lamp 300 can be provided to a user who cannot easily distinguish the tubular LED lamp from a conventional fluorescent lamp.

As an example, referring to FIG. 2A to FIG. 2C, with regard to embodiments corresponding to FIG. 2A and FIG. 2B among two of the four pins 111 and 121 are nonconductive and the other two are conductive, one (110 or 120) of the first base 110 and the second base 120 which are composed of the base set 100 will be briefly explained. For ease of explanation, one (110 or 120) of the first base 110 and the second base 120 is called the base 110 or 120 for the LED lamp.

Referring to FIG. 2A and FIG. 2B, the base 110 or 120 for the LED lamp includes a cap 121 or 122 which covers an end of the tube 310 of the LED lamp 300, and two pins 111 or 121 which are extended respectively from the cap 121 or 122 toward the outside of an end of the tube 310. At this time, as shown in FIG. 2A and FIG. 2B, one of the two pins 111 or 121 is nonconductive and the other one is conductive.

The two pins 111 or 121 are connected to the socket 210 or 220 for LED lamp which will be explained later, and the socket 210 or 220 may include two pin holes 211 or 221 into which the two pins 111 or 121 can be connected.

In addition, as an example, the socket for the LED lamp may be a socket for a fluorescent lamp.

The socket 210 or 220 for the LED lamp may be connected to a switching mode power supply (SMPS) 230, which converts a supplied alternating current to a direct current and applies the converted direct current, so that the LED lamp 300 can be driven by being supplied with a direct current to the other conductive one of the two pins 111 or 121.

Explanations of the socket 210 or 220 for the LED lamp will be made together with explanations of a socket set according to an embodiment of the present invention.

Here in above, it is described that safety even in a case that the base set 100 is connected to a conventional fluorescent lamp socket can be secured by making some pin(s) nonconductive and the other pins conductive. Then, the socket set 200 including a switching mode power supply (SMPS) 230 which is needed for applying a normal direct current to the base set 100 for the LED lamp and driving the same and the socket 210 and 220 for the LED lamp will be explained.

Here, since the socket set 200 is connected to the base set 100, features and reference numerals of the base set 100 may be referred to while explanations for the socket set 200 will be made. In addition, explanations for the repeated parts which have been explained with the base set 100 in advance will be made briefly or omitted.

Referring to FIG. 3, the socket set 200 includes a switching mode power supply (SMPS) 230 which converts a supplied alternating current to a direct current and applies the converted direct current to the base set 100, a first socket for the LED lamp including two first pin holes 211 into which the two first pins 111 are inserted respectively, and a second socket 220 for the LED lamp including two second pin holes 221 into which two second pins 121 are inserted respectively.

At this time, the SMPS 230 is connected to the first socket 210 and the second socket 220 such that a direct current is applied to the conductive pins among the two first pins 111 and the two second pins 121 and thereby driving the LED lamp 300. Electric power is supplied to the LED lamp 300 through the base set 100 only in an electric wiring exclusively designed for the LED lamp 300 using a direct current by the connection of the SMPS 230. Accordingly, problems such as decrease of life span, malfunction, fire risk which may be caused by applying of unsuitable current to the LED lamp 300 can be prevented.

As an example, the first socket 210 and the second socket 220 may be a socket for a conventional fluorescent lamp. That is, even though a socket for a conventional fluorescent lamp is used as the sockets 210 and 220, if the SMPS 230 of the socket 200 is connected to the sockets 210 and 220 to supply a normal direct current to the base set 100, the LED lamp 300 can be normally driven.

As such, if the sockets 210 and 220 for the LED lamp are realized by using a socket for a fluorescent lamp, a socket of a conventional lamp assembly can be used without installing a new socket for an LED lamp, and thereby time and cost can be substantially reduced. That is, since a socket for a conventional fluorescent lamp can be directly used as the sockets 210 and 220 for the LED lamp, the LED lamp 300 can be connected for use to a conventional lamp assembly without substituting a socket for a fluorescent lamp of a conventional lamp assembly with a new socket for a LED lamp, so time and cost for replacing a conventional fluorescent lamp with the LED lamp 300 can be substantially reduced.

In this case, the base 110 and 120 for an LED lamp of the base set 100 are preferably provided with two pins 111 and 121 respectively in accordance with the structure of the sockets 210 and 220 which are the same with a socket of a fluorescent lamp.

In addition, since the SMPS 230 applies a direct current to only some of the four pins 111 and 121, even when a user connects a fluorescent lamp by mistake, an alternating current is not applied to four pins of a base of a fluorescent lamp, so the fluorescent lamp is not driven and thereby safety can be secured. But, in order to prevent a user from wasting time and effort by mistakenly connecting a fluorescent lamp to the sockets 210 and 220 for an LED lamp due to confusion with a socket for a fluorescent lamp, it may be preferable to make a mark for differentiating from a socket for a fluorescent lamp.

Meanwhile, a lamp assembly 1000 according to an embodiment of the present invention will be explained with reference to FIG. 3. Since the lamp assembly 1000 includes the base set 100 and the socket set 200, features and reference numerals of the base set 100 and the socket set 200 may be referred to while explanations for the lamp assembly 1000 will be made. In addition, explanations for the repeated parts which have be explained with the base set 100 and the socket set 200 in advance will be made briefly or omitted.

As shown in FIG. 3, the lamp assembly 1000 includes a cover frame 400 an inside of which is opened in a downward direction and an upper surface of which is connected to a ceiling, the socket set 200 which is connected to the cover frame 400, and the base set 100 which is connected to the socket set 200.

At this time, in case that the sockets 210 and 200 for an LED lamp of the socket set 200 are realized by a conventional socket of a fluorescent lamp, the cover frame 400 can also be realized by a conventional cover frame of a fluorescent lamp. In this case, the lamp assembly can be formed by additionally providing the LED lamp 300 having the base set 100 according to an embodiment of the present invention and the SMPS 230 used for the base set 100 according to an embodiment of the present invention and by assembling the same as described above, so time and cost can be substantially reduced.

For reference, the LED lamp 300 which may be used with the base set 100 is generally a tubular type and can be used by reusing a conventional cover frame of a tubular fluorescent lamp. But, the LED lamp 300 is not limited to the tubular type but may be various types such as a curved type.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

DESCRIPTION OF REFERENCE NUMERALS FOR MAIN PARTS OF DRAWINGS

| | |
|---|---|
| 100. base set for an LED lamp | |
| 110. first base | |
| 111. first pins | 112. first cap |
| 120. second base | |
| 121. second pins | 122. second cap |
| 200. socket for an LED lamp | |
| 210. first socket | |
| 211. first pin holes | |
| 220. second socket | |
| 221. second pin holes | |
| 230. switching mode power supply | |
| 300. light emitting diode | 310. tube |
| 400. cover frame | 1000. lamp assembly |

What is claimed is:

1. A base for a light emitting diode lamp comprising:

a cap that covers an end of a tube of the light emitting diode lamp; and two pins that are extended respectively from the cap toward the outside of an end of the tube;

wherein one of the two pins is nonconductive and the other one of the two pins is conductive;

wherein the two pins are connected to a socket for a light emitting diode, and the socket includes two pin holes into which the two pins are connected;

wherein the socket is connected to a SMPS (switching mode power supply), which converts a supplied alternating current to a direct current and applies the converted direct current, so that the light emitting diode lamp is driven by being supplied with the converted direct current to the other conductive one of the two pins; and wherein the conductive pin is electrically connected to the SMPS (switching mode power supply) via the socket.

2. The base of claim 1, wherein the socket for the light emitting diode is a socket for a fluorescent lamp.

3. A base set for a light emitting diode lamp comprising:

a first base for a light emitting diode having a first cap that covers one end of a tube of the light emitting diode and two first pins that are extended respectively from the first cap toward the outside of the one end of the tube; and a second base for a light emitting diode having a second cap that covers the other end of the tube of the light emitting diode and two second pins that are extended respectively from the second cap toward the outside of the other end of the tube;

wherein one or two of the two first pins and the two second pins is nonconductive and the other thereof is conductive;

wherein the two first pins and the two second pins are respectively connected to a first socket for a light emitting diode lamp and a second socket for a light emitting diode lamp, and the first socket and the second socket respectively include two first pin holes and two second pin holes into which the two first pins and the two second pins are respectively connected;

wherein the first socket and the second socket are respectively connected to a SMPS (switching mode power supply), which converts a supplied alternating current to a direct current and applies the converted direct current, so that the light emitting diode lamp is driven by being supplied with the converted direct current to the other conductive pins; and wherein the conductive pin is electrically connected to the SMPS (switching mode power supply) via the socket.

4. The base set of claim 3, wherein the first socket and the second socket are respectively a socket for a fluorescent lamp.

5. A socket set for a light emitting diode lamp comprising:

a SMPS (switching mode power supply) that converts a supplied alternating current to a direct current and applies the converted direct current to a base set for a light emitting diode lamp including a first base for a light emitting diode having a first cap that covers one end of a tube of the light emitting diode and two first pins that are extended respectively from the first cap toward the outside of the one end of the tube, and a second base for a light emitting diode having a second cap that covers the other end of the tube of the light emitting diode and two second pins that are extended respectively from the second cap toward the outside of the other end of the tube, one or two of the two first pins and the two second pins being nonconductive and the other thereof being conductive;

a first socket for a light emitting diode lamp including two first pin holes into which the two first pins are connected; and a second socket for a light emitting diode lamp including two second pin holes into which the two second pins are connected;

wherein the SMPS is connected to the first socket and the second socket so that the light emitting diode lamp is driven by being supplied with the converted direct current to the other conductive pins; and wherein the conductive pin is electrically connected to the SMPS (switching mode power supply) via the socket.

6. The socket set of claim 5, wherein the first socket and the second socket are respectively a socket for a fluorescent lamp.

7. A lamp assembly comprising:

a cover frame, an inside of which is opened in a downward direction and an upper surface of which is connected to a ceiling;

a socket set for a light emitting diode lamp being connected to the cover frame; and a light emitting diode including a base set for a light emitting diode lamp, the base set being connected to the socket set;

wherein the socket set includes:

a SMPS (switching mode power supply) that converts a supplied alternating current to a direct current and applies the converted direct current to the base set;

a first socket for a light emitting diode lamp including two first pin holes into which the two first pins are connected; and a second socket for a light emitting diode lamp including two second pin holes into which the two second pins are connected;

wherein the SMPS is connected to the first socket and the second socket so that the light emitting diode lamp is driven by being supplied with the converted direct current to the other conductive pins;

wherein the base set includes:

a first base for a light emitting diode having a first cap that covers one end of a tube of the light emitting diode and two first pins that are extended respectively from the first cap toward the outside of the one end of the tube; and a second base for a light emitting diode having a second cap that covers the other end of the tube of the light emitting diode and two second pins that are extended respectively from the second cap toward the outside of the other end of the tube;

wherein one or two of the two first pins and the two second pins is nonconductive and the other thereof is conductive; and wherein the conductive pin is electrically connected to the SMPS (switching mode power supply) via the socket.

8. The lamp assembly claim 7, wherein the two first pins and the two second pins are respectively connected to the first socket and the second socket, and the first socket and the second socket respectively includes two first pin holes and two second pin holes into which the two first pins and the two second pins are respectively connected.

9. The lamp assembly of claim 7, wherein the first socket and the second socket are respectively a socket for a fluorescent lamp.

10. The lamp assembly of claim 7, wherein the first socket and the second socket are respectively connected to the SMPS.

* * * * *